US006759373B2

(12) United States Patent
Tazaki

(10) Patent No.: US 6,759,373 B2
(45) Date of Patent: Jul. 6, 2004

(54) REFRIGERATING MACHINE OIL COMPOSITION FOR CARBON DIOXIDE REFRIGERANT

(75) Inventor: Toshinori Tazaki, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 10/168,863

(22) PCT Filed: Dec. 26, 2000

(86) PCT No.: PCT/JP00/09228

§ 371 (c)(1),
(2), (4) Date: Jun. 26, 2002

(87) PCT Pub. No.: WO01/48127

PCT Pub. Date: Jul. 5, 2001

(65) Prior Publication Data

US 2003/0032563 A1 Feb. 13, 2003

(30) Foreign Application Priority Data

Dec. 28, 1999 (JP) ..... 11-373344

(51) Int. Cl.[7] ..... C10M 107/34; C09K 5/00

(52) U.S. Cl. ..... 508/462; 508/485; 508/539; 508/579; 252/68

(58) Field of Search ..... 508/579, 462, 508/485

(56) References Cited

U.S. PATENT DOCUMENTS

| | | | | |
|---|---|---|---|---|
| 6,193,906 | B1 | 2/2001 | Kaneko et al. | 252/68 |
| 6,263,683 | B1 | 7/2001 | Tazaki | 62/114 |
| 6,267,907 | B1 * | 7/2001 | Tolfa et al. | 252/68 |
| 6,306,803 | B1 * | 10/2001 | Tazaki | 508/539 |
| 6,322,719 | B2 | 11/2001 | Kaneko et al. | 252/68 |
| 6,339,932 | B1 * | 1/2002 | Yamaguchi et al. | 62/114 |
| 6,354,094 | B2 | 3/2002 | Tazaki | 62/114 |
| 6,613,725 | B1 * | 9/2003 | Tazaki | 508/579 |

FOREIGN PATENT DOCUMENTS

| | | |
|---|---|---|
| EP | 499793 | 8/1992 |
| EP | 0 629 687 | 12/1994 |
| EP | 0 634 467 | 1/1995 |
| EP | 0 861 883 | 9/1998 |
| JP | 5-194968 | 8/1993 |
| JP | 10-46169 | 2/1998 |
| WO | WO 98/50499 | 11/1998 |
| WO | WO 99/58628 | 11/1999 |
| WO | 99/58628 | 11/1999 |

OTHER PUBLICATIONS

Patent Abstracts of Japan, JP 10–046169, Feb. 17, 1998.
Patent Abstracts of Japan, JP 05–194968, Aug. 3, 1993.

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

The present invention describes a refrigerating oil composition for a carbon dioxide refrigerant comprising a base oil composition which comprises (A) a polyoxyalkylene glycol having a kinematic viscosity of 3 to 50 $mm^2/s$ at 100° C. and at least one component selected from (B) a carbonate-based carbonyl derivative having a kinematic viscosity of 3 to 50 $mm^2/s$ at 100° C. and (C) a polyol ester having a kinematic viscosity of 3 to 50 $mm^2/s$ at 100° C., wherein an amount of (B) and/or (C) is 0.1 to 40% by weight of the total base oil composition. The composition exhibits sufficient antiwear, excellent lubricity and miscibility with carbon dioxide refrigerants and can be used for a long time with stability in the refrigerating cycle using a refrigerant comprising carbon dioxide in the supercritical condition of a high temperature and a high pressure as the main component.

18 Claims, 2 Drawing Sheets

REFRIGERATING MACHINE OIL COMPOSITION FOR CARBON DIOXIDE REFRIGERANT

TECHNICAL FIELD

The present invention relates to a refrigerating oil composition for a refrigerator using a carbon dioxide ($CO_2$) refrigerant and, more particularly, to a refrigerating oil composition which can be used for compression-type refrigerators using a carbon dioxide refrigerant, which are, specifically, refrigerating and air conditioning apparatuses such as automobile air conditioners, refrigerators, freezers, general use air conditioners and heat pumps.

BACKGROUND ART

In general, refrigerators such as compression-type refrigerators comprising a compressor, a condenser, an expansion valve and an evaporator has a structure in which a mixed fluid of a refrigerant and a lubricating oil is circulated in the closed system. Heretofore, chlorofluorocarbons such as dichlorodifluoromethane (R-12) and chlorodifluoromethane (R-22) have been used as the refrigerant for the compression-type refrigerators and various types of lubricating oils have been produced and used in combination with the refrigerant. However, since there is the possibility that these chlorofluorocarbons cause environmental pollution such as ozonosphere destruction in stratosphere when these substances are released into the atmosphere, the regulation on the chlorofluorocarbons is becoming stricter worldwide. Due to this situation, novel refrigerants such as hydrofluorocarbons and fluorocarbons, typical examples of which include 1,1,1,2-tetrafluoroethane (R-134a), are attracting attention. Although there is no anxiety that the hydrofluorocarbons and the fluorocarbons destruct the ozonosphere, there is the fear that these substances might cause global warming due to the longevity of these substances in the atmosphere. Therefore, the use of a natural substance-based refrigerant that does not cause these problems is considered.

Carbon dioxide is advantageous as the foregoing natural substance since it is harmless to the environment and safe to the human beings. Further, it is easily available anywhere as desired, it is not necessary to be recycled and it is very inexpensive. Therefore, carbon dioxide has heretofore been used as a refrigerant for refrigerators. However, the refrigerating system using the carbon dioxide refrigerant is a system having a higher pressure and a higher temperature than those of the refrigerating system using R-134a or the like and, moreover, is a system with transitional supercritical cycle having the supercritical condition in the refrigerant cycle. Therefore, when this system is lubricated with a lubricating oil which has heretofore been used conventionally, there is a great possibility of causing problems on lubrication in that deterioration in the lubricating property such as insufficient wear resistance takes place and stable use cannot be achieved for a long time due to a decrease in stability.

Polyoxyalkylene glycols have been used advantageously in the systems using the R-134a refrigerant and it is considered that polyalkylene glycols can be applied to the system using the carbon dioxide refrigerant. However, miscibility of the polyoxyalkylene glycols with carbon dioxide is not sufficiently great.

Under the foregoing circumstances, an object of the present invention is to provide a refrigerating oil composition for a carbon dioxide refrigerant that exhibits sufficient antiwear and excellent lubricating property, improved miscibility with the carbon dioxide refrigerant and that can be used for a long time with stability in the refrigerating cycle using the refrigerant comprising carbon dioxide in the supercritical condition of a high temperature and a high pressure as the main component.

As the result of intensive studies by the inventors, it was found that the object of the present invention could be effectively achieved by using a composition containing a base oil composition that comprises a polyoxyalkylene glycol with a specific kinematic viscosity, a specific amount of a carbonate-based carbonyl derivative and/or a polyol ester each having a specific kinematic viscosity. The present invention has been completed based on this finding.

DISCLOSURE OF THE INVENTION

The refrigerating oil composition for a carbon dioxide refrigerant as a natural substance-based refrigerants of the present invention has the following characteristics.

(1) A refrigerating oil composition for a carbon dioxide refrigerant containing a base oil composition which comprises (A) a polyoxyalkylene glycol having a kinematic viscosity of 3 to 50 $mm^2/s$ at 100° C. and at least one component selected from (B) a carbonate-based carbonyl derivative having a kinematic viscosity of 3 to 50 $mm^2/s$ at 100° C. and (C) a polyol ester having a kinematic viscosity of 3 to 50 $mm^2/s$ at 100° C., wherein an amount of (B) and/or (C) is 0.1 to 40% by weight to the total base oil composition.

(2) A refrigerating oil composition for a carbon dioxide refrigerant of the description (1), wherein the base oil composition has a kinematic viscosity of 7 to 30 $mm^2/s$ at 100° C. and a viscosity index of 130 or greater.

(3) A refrigerating oil composition for a carbon dioxide refrigerant of the foregoing description (1) or (2), which further comprises at least one acid catcher in an entire amount of 0.005 to 5.0% by weight.

(4) A refrigerating oil composition for a carbon dioxide refrigerant of the foregoing description (1) or (2), which further comprises at least one extreme pressure agent in an entire amount of 0.005 to 5.0% by weight.

(5) A refrigerating oil composition for a carbon dioxide refrigerant of the description (4), wherein the extreme pressure agent is at least one agent selected from a group consisting of metal salts of carboxylic acids and phosphorus-based extreme pressure agents.

Figure 1:
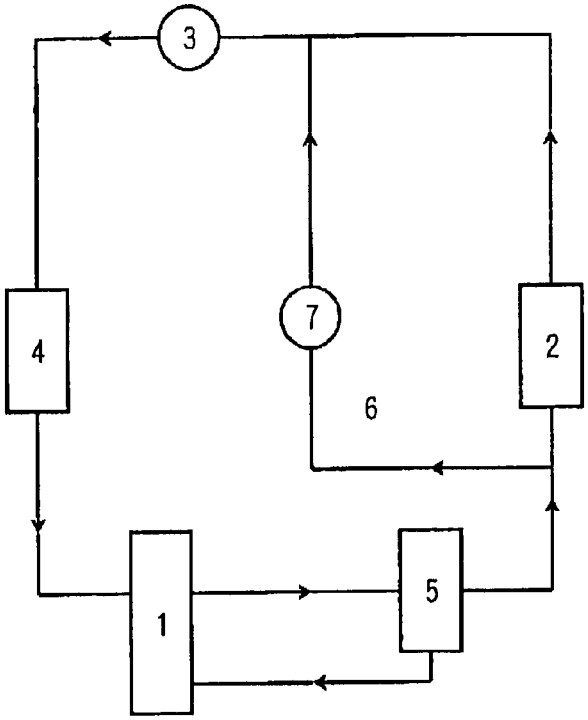
FIG. 1 shows a flow diagram that exhibits an example of the compression type refrigerating cycle of the "compressor—condenser—expansion valve—evaporator" system having an oil separator and a hot gas line.

Descriptions of the numerical symbols in the Figures are as the followings:

1: A compressor

2: A condenser

3: An expansion valve

4: An evaporator

5: An oil separator

6: A hot gas line

7: A valve for a hot gas line

THE MOST PREFERRED EMBODIMENT TO CARRY OUT THE INVENTION

Examples of (A) the polyoxyalkylene glycol used in the present invention include compounds represented by general formula (1):

$$R^1—[(OR^2)_m—OR^3]_n \quad (1)$$

wherein $R^1$ represents hydrogen atom, an alkyl group having 1 to 10 carbon atoms, an acyl group having 2 to 10 carbon atoms or an aliphatic hydrocarbon group having 1 to 10 carbon atoms and having 2 to 6 bonding portions; $R^2$ represents an alkylene group having 2 to 4 carbon atoms; $R^3$ represents hydrogen atom, an alkyl group having 1 to 10 carbon atoms or an acyl group having 2 to 10 carbon atoms; n represents an integer of 1 to 6; and m represent numbers giving an average value of numbers represented by m×n in a range of 6 to 80.

In the general formula (1), the alkyl group having 1 to 10 carbon atoms which is represented by $R^1$ or $R^3$ may be any of linear, branched and cyclic alkyl groups. Examples of the alkyl group include methyl group, ethyl group, n-propyl group, isopropyl group, various types of butyl group, various types of pentyl group, various types of hexyl group, various types of heptyl group, various types of octyl group, various types of nonyl group, various types of decyl group, cyclopentyl group and cyclohexyl group. When the number of carbon atom in the alkyl group exceeds 10, miscibility with the refrigerant reduces and phase separation occasionally takes place. It is preferable that the number of carbon atom in the alkyl group is 1 to 6.

In the acyl group having 2 to 10 carbon atoms which is represented by any of $R^1$ and $R^3$, the portion of an alkyl group may be any of linear, branched and cyclic alkyl groups. Examples of the portion of an alkyl group in the acyl group include the alkyl groups having 1 to 9 carbon atoms among the groups described above as the examples of the alkyl group. When the number of carbon atom in the acyl group exceeds 10, miscibility with the refrigerant reduces and phase separation occasionally takes place. It is preferable that the number of carbon atom in the acyl group is 2 to 6. When $R^1$ and $R^3$ each represent an alkyl group or an acyl group, $R^1$ and $R^3$ may represent the same group or different groups. When n represents a number of 2 or greater, the atoms and the groups represented by the plurality of $R^3$ in one molecule may be the same with or different from each other.

When $R^1$ represents an aliphatic hydrocarbon group having 1 to 10 carbon atoms and having 2 to 6 bonding portions, the aliphatic hydrocarbon group may be linear or cyclic. Examples of the aliphatic hydrocarbon having 2 bonding portions include ethylene group, propylene group, butylene group, pentylene group, hexylene group, heptylene group, octylene group, nonylene group, decylene group, cyclopentylene group and cyclohexylene group. Examples of the aliphatic hydrocarbon group having 3 to 6 bonding portions include residual groups obtained by removing hydroxyl groups from polyhydric alcohols such as trimethylolpropane, glycerol, pentaerythritol, sorbitol, 1,2,3-trihydroxycyclohexane and 1,3,5-trihydroxycyclohexane. When the number of carbon atoms in the aliphatic hydrocarbon groups exceeds 10, miscibility with the refrigerant reduces and phase separation occasionally takes place. It is preferable that the number of carbon atom is 2 to 6.

In the present invention, it is preferable that at least one of $R^1$ and $R^3$ represents an alkyl group, more preferably an alkyl group having 1 to 3 carbon atoms and most preferably methyl group from the standpoint of the viscosity. From the same standpoint, it is preferable that $R^1$ and $R^3$ each represent an alkyl group and more preferable that they each represent a methyl group.

In the foregoing general formula (1), $R^2$ represents an alkylene group having 2 to 4 carbon atoms. Examples of the oxyalkylene group as the repeating unit include oxyethylene group, oxypropylene group and oxybutylene group. The oxyalkylene groups in one molecule may be the same with or different from each other. It is preferable that the oxyalkylene group is a copolymer comprising oxyethylene group (EO) and oxypropylene group (PO). From the standpoint of the load of seizure and the viscosity, it is preferable that the value of EO/(PO+EO) is in the range of 0.1 to 0.8. From the standpoint of the hygroscopic property, it is preferable that the value of EO/(PO+EO) is in the range of 0.3 to 0.6.

In the foregoing general formula (1), n represents an integer of 1 to 6 which is decided in accordance with the number of the bonding portion of the group represented by $R^1$. For example, n represents 1 when $R^1$ represents an alkyl group or an acyl group and represents 2,3,4,5 or 6 when $R^1$ represents an aliphatic hydrocarbon group having 2,3,4,5 or 6 bonding portions, respectively. m represent numbers giving an average value of numbers represented by m×n in the range of 6 to 80. When the average value of numbers represented by m×n is outside the range, the object of the present invention is not sufficiently achieved.

The polyalkylene glycol represented by the foregoing general formula (1) includes polyalkylene glycols having hydroxyl groups at the ends. Polyalkylene glycol having hydroxyl groups at the ends can be advantageously used as long as the content of the hydroxyl group at the ends is 50% by mole or smaller based on the total number of the terminal groups. When the above-described content exceeds 50% by mole, the hygroscopic property increases and the viscosity index reduces. Therefore, such a content is not preferable.

As the polyalkylene glycol described above, polyoxypropylene glycol dimethyl ethers represented by general formula (2):

$$CH_3O—(\overset{\overset{\displaystyle CH_3}{|}}{C}HCH_2O)_x—CH_3 \quad (2)$$

wherein x represents a number of 6 to 80, and polyoxyethylene-polyoxypropylene glycol dimethyl ethers represented by general formula (3):

$$CH_3O—(\overset{\overset{\displaystyle CH_3}{|}}{C}HCH_2O)_a—(CHCH_2O)_b—CH_3 \quad (3)$$

wherein a and b each represent a number of 1 or greater and the sum of the numbers represented by a and b is in the range of 6 to 80, are preferable from the standpoint of the economic superiority and the refrigerating effect.

Polyoxypropylene glycol monobutyl ethers represented by general formula (4):

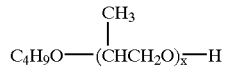

(4)

wherein x represents a number of 6 to 80, and polyoxypropylene glycol diacetates are preferable from the standpoint of the economic superiority. As the polyalkylene glycol represented by the foregoing general formula (1), any compounds described in detail in Japanese Patent Application Laid-Open No. Heisei 2(1990)-305893 can be used.

In the present invention, polyoxyalkylene glycol derivatives having at least one constituting unit represented by the following general formula (5):

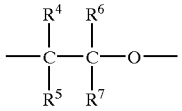

(5)

can be used. In general formula (5), $R^4$ to $R^7$ each represent hydrogen atom, a hydrocarbon group having 1 to 10 carbon atoms or a group represented by general formula (6):

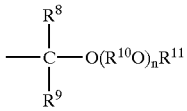

(6)

and at least one of $R^4$ to $R^7$ represents a group represented by general formula (6). In general formula (6), $R^8$ and $R^9$ each represent hydrogen atom, a monovalent hydrocarbon group having 1 to 10 carbon atoms or an alkoxyalkyl group having 2 to 20 carbon atoms, $R^{10}$ represents an alkylene group having 2 to 5 carbon atoms, a substituted alkylene group having alkyl groups as the substituents and 2 to 5 carbon atoms in the entire group or a substituted alkylene group having alkoxyalkyl groups as the substituents and 4 to 10 carbon atoms in the entire group, n represents an integer of 0 to 20 and $R^{11}$ represents a monovalent hydrocarbon group having 1 to 10 carbon atoms.

In the foregoing general formula (5), $R^4$ to $R^7$ each represent hydrogen atom, a monovalent hydrocarbon group having 1 to 10 carbon atoms or a group represented by general formula (6). As the monovalent hydrocarbon group having 1 to 10 carbon atoms, monovalent hydrocarbon groups having 6 or fewer carbon atoms are preferable and alkyl groups having 3 or fewer carbon atoms are more preferable.

In general formula (6), $R^8$ and $R^9$ each represent hydrogen atom, a monovalent hydrocarbon group having 1 to 10 carbon atoms or an alkoxyalkyl group having 2 to 20 carbon atoms. Among these groups, alkyl groups having 3 or fewer carbon atoms and alkoxyalkyl groups having 6 or fewer carbon atoms are preferable.

In general formula (6), $R^{10}$ represents an alkylene group having 2 to 5 carbon atoms, a substituted alkylene group having alkyl groups as the substituents and 2 to 5 carbon atoms in the entire group or a substituted alkylene group having alkoxyalkyl groups as the substituents and 4 to 10 carbon atoms in the entire group. It is preferable that $R^{10}$ represents ethylene group or a substituted ethylene group having 6 or fewer carbon atoms. $R^{11}$ represents a monovalent hydrocarbon group having 1 to 10 carbon atoms, preferably a hydrocarbon group having 6 or fewer carbon atoms and more preferably a hydrocarbon group having 3 or fewer carbon atoms.

In the foregoing general formula (5), at least one of $R^4$ to $R^7$ represents the group represented by the foregoing general formula (6). It is preferable that one of $R^4$ and $R^6$ represents the group represented by general formula (6) and the other of $R^4$ and $R^6$, $R^5$ and $R^7$ each represent hydrogen atom or a monovalent hydrocarbon group having 1 to 10 carbon atoms.

The polyoxyalkylene glycol derivative comprises at least one constituting unit represented by general formula (5). The polyalkylene glycol derivatives can be divided into the following three types of compounds: homopolymers comprising a single type of the constituting unit represented by general formula (5); copolymers comprising two or more types of the constituting units represented by general formula (5); and copolymers comprising the constituting units represented by general formula (5) and other constituting units such as constituting units represented by general formula (7):

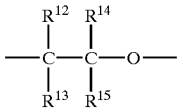

(7)

wherein $R^{12}$ to $R^{15}$ each represent hydrogen atom or an alkyl group having 1 to 3 carbon atoms.

Preferable examples of the homopolymer described above include homopolymers comprising 1 to 200 constituting units represented by general formula (5) and having hydroxyl group, an acyloxyl group having 1 to 10 carbon atoms, an alkoxyl group having 1 to 10 carbon atoms or an aryloxyl groups as the terminal group. On the other hand, preferable examples of the foregoing copolymer include copolymers which comprise two types of constituting units A and B each represented by general formula (5) each in a number of 1 to 200 and copolymers which comprise 1 to 200 constituting units A represented by general formula (5) and 1 to 200 constituting units C represented by general formula (7), each copolymer having hydroxyl group, an acyloxyl group having 1 to 10 carbon atoms, an alkoxyl group having 1 to 10 carbon atoms or an aryloxyl groups as the terminal group. These copolymers include alternating copolymers, random copolymers and block copolymers comprising constituting units A and constituting units B (or constituting units C) and graft copolymers comprising the main chain of the constituting units A to which constituting units B are grafted.

In the present invention, as (B) the carbonate-based carbonyl derivative, a carbonate oil represented by any of the following general formulae (8), (9), (10) or (11) can be used.

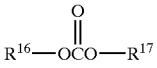

(8)

In the general formula (8), $R^{16}$ and $R^{17}$ each independently represent a linear or branched hydrocarbon group having 1 to 30 carbon atoms, a hydrocarbon group having an aromatic ring or alicyclic bond and 6 to 30 carbon atoms, a linear or branched hydrocarbon group having ether bond and 2 to 135 carbon atoms or a hydrocarbon group having ether bond, 7 to 135 carbon atoms and an aromatic ring or an alicyclic bond.

(9)

$$R^{18}-\overset{\overset{\displaystyle O}{\|}}{O}CO-(R^{19}\overset{\overset{\displaystyle O}{\|}}{O}CO)-R^{20}$$

In the general formula (9), $R^{18}$ and $R^{20}$ each independently represent a linear or branched hydrocarbon group having 1 to 30 carbon atoms, a hydrocarbon group having an aromatic ring or alicyclic bond and 6 to 30 carbon atoms, a linear or branched hydrocarbon group having ether bond and 2 to 135 carbon atoms or a hydrocarbon group having ether bond, 7 to 135 carbon atoms and an aromatic ring or an alicyclic bond; $R^{19}$ represents a linear or branched divalent hydrocarbon group having 1 to 12 carbon atoms or a divalent hydrocarbon group having an aromatic ring or an alicyclic bond; and a represents an integer of 1 to 16.

(10)

$$R^{21}-\overset{\overset{\displaystyle O}{\|}}{O}C[(OR^{22})_xO\overset{\overset{\displaystyle O}{\|}}{C}O]_y-R^{23}$$

In the general formula (10), $R^{21}$ and $R^{23}$ each independently represent a linear or branched hydrocarbon group having 1 to 30 carbon atoms, a hydrocarbon group having an aromatic ring or alicyclic bond and 6 to 30 carbon atoms, a linear or branched hydrocarbon group having ether bond and 2 to 135 carbon atoms or a hydrocarbon group having ether bond, 7 to 135 carbon atoms and an aromatic ring or an alicyclic bond; $R^{22}$ represents an alkylene group having 1 to 6 carbon atoms; x represents an integer of 1 to 40; and y represents an integer of 1 to 12.

(11)

$$\begin{array}{l} CH_2-O-(R^{24}O)_p-\overset{\overset{\displaystyle O}{\|}}{C}O-R^{27} \\ | \\ [ZC-O-(R^{25}O)_p-\overset{\overset{\displaystyle O}{\|}}{C}O-R^{28}]_q \\ | \\ CH_2-O-(R^{26}O)_p-\overset{\overset{\displaystyle O}{\|}}{C}O-R^{29} \end{array}$$

In the general formula (11), $R^{24}$, $R^{25}$ and $R^{26}$ each independently represent an alkylene group having 1 to 6 carbon atoms; $R^{27}$, $R^{28}$ and $R^{29}$ each independently represent a linear or branched hydrocarbon group having 1 to 30 carbon atoms, a hydrocarbon group having an aromatic ring or alicyclic bond and 6 to 30 carbon atoms, a linear or branched hydrocarbon group having ether bond and 2 to 135 carbon atoms or a hydrocarbon group having ether bond, 7 to 135 carbon atoms and an aromatic ring or an alicyclic bond; Z represents hydrogen atom, a hydrocarbon group having 1 to 6 carbon atoms or $-O-(R^{24}O)_p-C(=O)O-R^{27}$, $R^{24}$ and $R^{27}$ being as defined above; p represents an integer of 0 to 12; and q represents an integer of 1 to 6.

Examples of the linear or branched hydrocarbon group represented by $R^{16}$ in the foregoing general formula (8) include linear and branched alkyl groups having 1 to 30 carbon atoms and preferably 1 to 12 carbon atoms. Specific examples of the above alkyl group include linear and branched alkyl groups such as $CH_3$ group, $C_2H_5$ group, $C_3H_7$ groups, $C_4H_9$ groups, $C_5H_{11}$ groups, $C_6H_{13}$ groups, $C_7H_{15}$ groups, $C_8H_{17}$ groups, $CgH_{19}$ groups, $C_{10}H_{21}$ groups and $C_{12}H_{25}$ groups. Examples of the hydrocarbon group having an aromatic ring which is represented by $R^{16}$ in the foregoing general formula (8) include hydrocarbon groups having 6 to 30 carbon atoms and preferably 6 to 20 carbon atoms such as aryl groups, arylalkyl groups and aromatic hydrocarbon groups having a divalent aromatic hydrocarbon group in the chain. Specific examples of the above group include aryl groups such as phenyl group, arylalkyl groups such as benzyl group and aromatic hydrocarbon groups having a divalent aromatic hydrocarbon group in the chain such as phenylene group ($-C_6H_4-$).

Examples of the hydrocarbon group having an alicyclic bond which is represented by $R^{16}$ in the foregoing general formula (8) include hydrocarbon groups having 6 to 30 carbon atoms and preferably 6 to 20 carbon atoms such as cycloalkyl groups, alkyl groups substituted with cycloalkyl groups and alicyclic hydrocarbon groups having a divalent alicyclic hydrocarbon group in the chain. Specific examples of these groups include cycloalkyl groups such as cyclohexyl group, alkyl groups substituted with a cycloalkyl group such as cyclohexyl group and alicyclic hydrocarbon groups having a divalent alicyclic hydrocarbon group such as cyclohexylene group ($-C_6H_{10}-$) in the chain.

Examples of the linear or branched hydrocarbon group having ether bond which is represented by $R^{16}$ in the foregoing general formula (8) include linear and branched aliphatic hydrocarbon groups having 2 to 135 carbon atoms and preferably 2 to 60 carbon atoms and ether bond such as groups represented by $C_nH_{2n+1}-OC_nH_{2n}-$ (in the formula, n=1~9) and $C_nH_{2n+1}-(OC_mH_{2m})_r-$ groups (in the formula, n=1~9, m=2~4 and r=1~30).

Typical examples of the groups are linear and branched aliphatic hydrocarbon groups having ether bond such as $CH_3(OC_2H_4)-$ group, $CH_3(OC_2H_4)_2-$ group, $CH_3(OC_2H_4)_3-$ group, $C_2H_5(OC_2H_4)-$ group, $C_2H_5(OC_2H_4)_2-$ group, $C_2H_5(OC_2H_4)_3-$ group, $C_3H_7(OC_2H_4)-$ group, $C_3H_7(OC_2H_4)_2-$ group, $C_3H_7(OC_2H_4)_3-$ group, $C_4H_9(OC_2H_4)-$ group, $C_4H_9(OC_2H_4)_2-$ group, $C_4H_9(OC_2H_4)_3-$ group, $C_6H_{13}(OC_2H_4)-$ group, $C_6H_{13}(OC_2H_4)_2-$ group, $C_6H_{13}(OC_2H_4)_3-$ group, $CH_3(OC_3H_6)-$ group, $CH_3(OC_3H_6)_2-$ group, $CH_3(OC_3H_6)_3-$ group, $C_2H_5(OC_3H_6)-$ group, $C_2H_5(OC_3H_6)_2-$ group, $C_2H_5(OC_3H_6)_3-$ group, $C_3H_7(OC_3H_6)-$ group, $C_3H_7(OC_3H_6)_2-$ group, $C_3H_7(OC_3H_6)_3-$ group, $C_4H_9(OC_3H_6)-$ group, $C_4H_9(OC_3H_6)_2-$ group, $C_4H_9(OC_3H_6)_3-$ group, $C_6H_{13}(OC_3H_6)-$ group, $C_6H_{13}(OC_3H_6)_2-$ group and $C_6H_{13}(OC_3H_6)_3-$ group.

In the foregoing general formula (8), the hydrocarbon group having an aromatic group and ether bond which is represented by $R^{16}$ is a hydrocarbon group having ether bond, an aromatic ring and 7 to 135 carbon atoms and preferably 7 to 30 carbon atoms. The ether bond may be bonded to the aromatic ring or to a group other than the aromatic ring. It is preferable that the ether bond is bonded to the aromatic ring. Specific examples of the above group include aromatic hydrocarbon groups having 7 to 135 and preferably 7 to 30 carbon atoms such as groups represented by $C_nH_{2n+1}-C_6H_4-(OC_mH_{2m})_r-$ (in the formula, $C_6H_4$ represents phenylene group, n=1~9, m=2~4 and r=1~30).

In the foregoing general formula (8), the hydrocarbon group having an alicyclic bond and ether bond which is represented by $R^{16}$ is a hydrocarbon group having ether bond, an alicyclic bond and 7 to 135 carbon atoms and preferably 7 to 30 carbon atoms. The ether bond and the alicyclic bond may be continuously or not continuously bonded to each other. It is preferable that the ether bond and the alicyclic bond are continuously bonded to each other. Specific examples of the above group include alicyclic hydrocarbon groups having 7 to 135 and preferably 7 to 30 carbon atoms such as groups represented by $C_nH_{2n+1}$—$C_6H_{10}$—$(OC_mH_{2m})_r$— (in the formula, $C_6H_{10}$ represents cyclohexylene group, n=1~9, m=2~4 and r=1~30).

In the foregoing general formula (8), examples of the groups represented by $R^{17}$ are the same as examples of the groups represented by $R^{16}$. $R^{16}$ and $R^{17}$ may represent the same group or different groups. Examples of the carbonate oil represented by the foregoing general formula (8) include monocarbonate oils represented by the foregoing general formula (8) in which the combination of the groups represented by $R^{16}$ and $R^{17}$ is selected from the above hydrocarbon groups. The monocarbonate oil represented by the foregoing general formula (8) may be used singly or as a mixture of two or more.

Examples of the linear or branched hydrocarbon group represented by $R^{18}$ in the foregoing general formula (9) include linear and branched alkyl groups having 1 to 30 carbon atoms and preferably 1 to 12 carbon atoms. Specific examples of the group include linear and branched alkyl groups such as $CH_3$ group, $C_2H_5$ group, $C_3H_7$ groups, $C_4H_9$ groups, $C_5H_{11}$ groups, $C_6H_{13}$ groups, $C_7H_{15}$ groups, $C_8H_{17}$ groups, $CgH_{19}$ groups, $C_{10}H_{21}$ groups and $C_{12}H_{25}$ groups.

Examples of the hydrocarbon group having an aromatic ring which is represented by $R^{18}$ in the foregoing general formula (9) include hydrocarbon groups having 6 to 30 carbon atoms and preferably 6 to 20 carbon atoms such as aryl groups, arylalkyl groups and aromatic hydrocarbon groups having a divalent aromatic hydrocarbon group in the chain. Specific examples of the above group include aryl groups such as phenyl group, arylalkyl groups such as benzyl group and aromatic hydrocarbon groups having a divalent aromatic hydrocarbon group in the chain such as phenylene group (—$C_6H_4$—).

Examples of the hydrocarbon group having an alicyclic bond which is represented by $R^{18}$ in the foregoing general formula (9) include hydrocarbon groups having 6 to 30 carbon atoms and preferably 6 to 20 carbon atoms such as cycloalkyl groups, alkyl groups substituted with cycloalkyl groups and alicyclic hydrocarbon groups having a divalent alicyclic hydrocarbon group in the chain. Specific examples of these groups include cycloalkyl groups such as cyclohexyl group, alkyl groups substituted with a cycloalkyl group such as cyclohexyl group and alicyclic hydrocarbon groups having a divalent alicyclic hydrocarbon group such as cyclohexylene group (—$C_6H_{10}$—) in the chain. When the group represented by $R^{18}$ in the foregoing general formula (9) does not have ether bond, it is preferable that $R^{18}$ represents an alkyl group.

Examples of the linear or branched hydrocarbon group having ether bond which is represented by $R^{18}$ in the foregoing general formula (9) include linear and branched aliphatic hydrocarbon group having 2 to 135 carbon atoms and preferably 2 to 60 carbon atoms and ether bond such as groups represented by $C_nH_{2n+1}$—$OC_nH_{2n}$— (in the formula, n=1~9) and $C_nH_{2n+1}$—$(OC_nH_{2m})_r$— (in the formula, n=1~9, m=2~4 and r=1~30).

Typical examples of these groups are linear and branched aliphatic hydrocarbon groups having ether bond such as $CH_3(OC_2H_4)$— group, $CH_3(OC_2H_4)_2$— group, $CH_3(OC_2H_4)_3$— group, $C_2H_5(OC_2H_4)$— group, $C_2H_5(OC_2H_4)_2$— group, $C_2H_5(OC_2H_4)_3$— group, $C_3H_7(OC_2H_4)$— group, $C_3H_7(OC_2H_4)_2$— group, $C_3H_7(OC_2H_4)_3$— group, $C_4H_9(OC_2H_4)$— group, $C_4H_9(OC_2H_4)_2$— group, $C_4H_9(OC_2H_4)_3$— group, $C_6H_{13}(OC_2H_4)$— group, $C_6H_{13}(OC_2H_4)_2$— group, $C_6H_{13}(OC_2H_4)_3$— group, $CH_3(OC_3H_6)$— group, $CH_3(OC_3H_6)_2$— group, $CH_3(OC_3H_6)_3$— group, $C_2H_5(OC_3H_6)$— group, $C_2H_5(OC_3H_6)_2$— group, $C_2H_5(OC_3H_6)_3$— group, $C_3H_7(OC_3H_6)$— group, $C_3H_7(OC_3H_6)_2$— group, $C_3H_7(OC_3H_6)_3$— group, $C_4H_9(OC_3H_6)$— group, $C_4H_9(OC_3H_6)_2$— group, $C_4H_9(OC_3H_6)_3$— group, $C_6H_{13}(OC_3H_6)$— group, $C_6H_{13}(OC_3H_6)_2$— group and $C_6H_{13}(OC_3H_6)_3$— group.

In the foregoing general formula (9), the hydrocarbon group having an aromatic group and ether bond which is represented by $R^{18}$ is a hydrocarbon group having ether bond, an aromatic ring and 7 to 135 carbon atoms and preferably 7 to 30 carbon atoms. The ether bond may be bonded to the aromatic ring or to a group other than the aromatic ring. It is preferable that the ether bond is bonded to the aromatic ring. Specific examples of the above group include aromatic hydrocarbon groups having 7 to 135 and preferably 7 to 30 carbon atoms such as groups represented by $C_nH_{2n+1}$—$C_6H_4$—$(OC_mH_{2m})_r$— (in the formula, $C_6H_4$ represents phenylene group, n=1~9, m=2~4 and r=1~30).

In the foregoing general formula (9), the hydrocarbon group having an alicyclic bond and ether bond which is represented by $R^{18}$ is a hydrocarbon group having ether bond, an alicyclic bond and 7 to 135 carbon atoms and preferably 7 to 30 carbon atoms. The ether bond and the alicyclic bond may be continuously or not continuously bonded to each other. It is preferable that the ether bond and the alicyclic bond are continuously bonded to each other. Specific examples of these groups include alicyclic hydrocarbon groups having 7 to 135 and preferably 7 to 30 carbon atoms such as groups represented by $C_nH_{2n+1}$—$C_6H_{10}$—$(OC_mH_{2m})_r$— (in the formula, $C_6H_{10}$ represents cyclohexylene group, n=1~9, m=2~4 and r=1~30).

Among the hydrocarbon groups having ether bond which is represented by $R^{18}$ in the foregoing general formula (9), linear and branched aliphatic hydrocarbon groups having ether bond are preferable. In the foregoing general formula (9), examples of the groups represented by $R^{20}$ are the same as examples of the groups represented by $R^{18}$. $R^{20}$ and $R^{18}$ may represent the same group or different groups.

Examples of the linear and branched hydrocarbon groups represented by $R^{19}$ in the foregoing general formula (9) include linear and branched alkylene groups having 1 to 12 carbon atoms and preferably 2 to 8 carbon atoms such as —$C_2H_4$—, —$C_3H_6$—, —$C_4H_8$—, —$CH_2C(CH_3)HCH_2$—, —$CH_2CH_2C(CH_3)HCH_2CH_2$—, —$C_6H_{12}$—, —$C_8H_{16}$—, —$C_{10}H_{20}$—, —$CH_2C((CH_3)_2CH_2$— and —$CH_2C(C_2H_5)(C_4H_9)CH_2$—. Examples of the divalent hydrocarbon group having an aromatic ring which is represented by $R^{19}$ in the foregoing general formula (9) include divalent aromatic hydrocarbon groups having 6 to 12 carbon atoms and preferably 6 to 10 carbon atoms and a divalent aromatic hydrocarbon group such as phenylene group (—$C_4H_6$—) in the chain. Among these groups, alkylene groups are preferable.

Examples of the divalent hydrocarbon group having an alicyclic bond which is represented by $R^{19}$ in the foregoing general formula (9) include alicyclic hydrocarbon groups having 6 to 12 carbon atoms and preferably 6 to 10 carbon atoms and a divalent alicyclic hydrocarbon group such as cyclohexylene group (—$C_6H_{10}$—) in the chain. Among the groups represented by $R^{19}$ in the foregoing general formula (9), alkylene groups are preferable.

In the foregoing general formula (9), a represents an integer of 1 to 16 and preferably an integer of 1 to 12. When a represents an integer of 2 or greater, the plurality of the constituting units represented by —$R^{19}OC(=O)O$— may be the same with or different from each other. Examples of the carbonate oil represented by the foregoing general formula (9) include polycarbonates represented by the general formula (9) in which the combination of the groups represented by $R^{18}$ to $R^{20}$ is selected from the above hydrocarbon groups. The polycarbonate oil represented by the general formula (9) may be used singly or as a mixture of two or more. Examples of the groups represented by $R^{21}$ to $R^{23}$ in the foregoing general formula (10) include the same groups described as the examples of the groups represented by $R^{18}$ to $R^{20}$, respectively, in the foregoing general formula (9).

In the foregoing general formula (10), x represents an integer of 1 to 40 and preferably an integer of 1 to 25 and y represents an integer of 1 to 12 and preferably an integer of 1 to 10. When x or y represents an integer of 2 or greater, the plurality of the constituting units may be the same with or different from each other. Examples of the carbonate oil represented by the general formula (10) include polycarbonates represented by the general formula (10) in which the combination of the groups represented by $R^{21}$ to $R^{23}$ is selected from the above hydrocarbon groups. The polycarbonate oil represented by the general formula (10) may be used singly or as a mixture of two or more.

Examples of the linear and branched hydrocarbon groups represented by $R^{24}$, $R^{25}$ or $R^{26}$ in the foregoing general formula (11) include linear and branched alkylene groups having 1 to 6 carbon atoms and preferably 2 to 4 carbon atoms such as —$C_2H_4$—, —$C_3H_6$—, —$C_4H_8$—, —$CH_2C(CH_3)HCH_2$—, —$CH_2CH_2C(CH_3)HCH_2CH_2$—, —$C_6H_{12}$—, and —$CH_2C((CH_3)_2)CH_2$—. The groups represented by $R^{24}$, $R^{25}$ and $R^{26}$ may be the same with or different from each other. Examples of the groups represented by $R^{27}$, $R^{28}$ and $R^{29}$ in the general formula (11) include the same groups described as the examples of the groups represented by $R^{18}$ in the foregoing general formula (9). The groups represented by $R^{27}$, $R^{28}$ and $R^{29}$ may be the same with or different from each other. Z in the general formula (11) represents hydrogen atom; a hydrocarbon group having 1 to 6 carbon atoms and preferably 1 to 4 carbon atoms such as alkyl groups such as $CH_3$ group, $C_2H_5$ group and $C_3H_7$ group; or —O—$(R^{24}O)_p$—C(=O)O—$R^{27}$ group. In this group, $R^{24}$ and $R^{27}$ represent the same groups as those described above. p represents the same integer as that represented by p which will be described in the following.

In the foregoing general formula (11), p represents an integer of 0 to 12 and preferably 1 to 10 and q represents an integer of 1 to 6 and preferably 1 to 4. When p or q represents an integer of 2 or greater, the plurality of the structural units may be the same with or different from each other. Examples of the carbonate oil represented by the general formula (11) include polycarbonates represented by the general formula (11) in which the combination of the groups represented by $R^{24}$ to $R^{29}$ is selected from the above hydrocarbon groups. The polycarbonate oil represented by the general formula (11) may be used singly or as a mixture of two or more.

In the present invention, the carbonate oils represented by the foregoing general formulae (8) to (11) may be used singly or in combination of two or more. The carbonate compounds represented by the foregoing general formulae (8), (9), (10) and (11) can be produced, for example, in accordance with the following process. By transesterification of an alcohol compound represented by the following general formula (12), (13), (14) or (15) with a carbonate represented by the following general formula (16), a corresponding carbonate compound represented by the foregoing general formula (8), (9), (10) and (11) can be obtained.

$$R^{16}(\text{or } R^{17})\text{—OH} \quad (12)$$

$$\text{HO—}R^{19}\text{—OH} \quad (13)$$

$$\text{H—}(OR^{22})\text{—OH} \quad (14)$$

$$\begin{array}{l} CH_2\text{—O—}(R^{24}O)_p\text{—H} \\ | \\ [ZC\text{—O—}(R^{25}O)_p\text{—H}]_q \\ | \\ CH_2\text{—O—}(R^{26}O)_p\text{—H} \end{array} \quad (15)$$

$$R^{30}\text{—}\overset{\overset{\displaystyle O}{\|}}{OCO}\text{—}R^{30} \quad (16)$$

In general formulae (12) to (15), $R^{16}$, $R^{17}$, $R^{19}$, $R^{22}$, $R^{24}$, $R^{25}$, $R^{26}$, x, p and q are the same as defined in the foregoing general formulae (8) to (11).

In general formula (16), the plurality of $R^{30}$ each independently represent a linear or branched hydrocarbon group or a hydrocarbon group having an aromatic ring or alicyclic bond, each group having 1 to 30 carbon atoms, or a linear or branched hydrocarbon group having ether bond or a hydrocarbon group having ether bond and aromatic ring or an alicyclic bond, each group having 2 to 135 carbon atoms.

The transesterification is conducted by heating the alcohol compound represented by the foregoing general formula (12), (13), (14) or (15) and the carbonate compound represented by the foregoing general formula (16) in amounts such that the ratio of the amounts by mole of the carbonate compound to the alcohol compound is in the range of 3 to 200 in the presence of a base catalyst. The formed alcohol $R^{22}OH$ is removed to the outside of the reaction system by distillation and the reaction is allowed to proceed until the conversion reaches 95% or greater. In the reaction, it is preferable that the air in the reactor is replaced with nitrogen. However, the reaction can be conducted without replacing the air with nitrogen.

After the base catalyst is removed, the unreacted carbonate compound represented by general formula (16) is removed to the outside of the reaction system by distillation and the carbonate compound represented by the foregoing general formula (8), (9), (10) or (11) can be obtained. The base catalyst is not particularly specified and a conventional base catalyst used for the transesterification can be used. Typical examples of the base catalyst include $NaOCH_3$.

In the present invention, as (C) the polyol ester, an ester of an aliphatic polyhydric alcohol and a linear or branched fatty acid can be used. Examples of the aliphatic polyhydric alcohol used for forming the ester include ethylene glycol, propylene glycol, butylene glycol, neopentyl glycol, trimethylolethane, ditrimethylolethane, trimethylolpropane, ditrimethylolpropane, glycerol, pentaerythritol, dipentaerythritol, tripentaerythritol and sorbitol.

As the fatty acid, fatty acids having 3 to 12 carbon atoms can be used. Preferable examples of the fatty acid include propionic acid, butyric acid, pivalic acid, valeric acid, caproic acid, heptanoic acid, octanoic acid, nonanoic acid, decanoic acid, dodecanoic acid, isovaleric acid, neopentanoic acid, 2-methylbutyric acid, 2-ethylbutyric acid, 2-methylhexanoic acid, 2-ethylhexanoic acid, isooctanoic acid, isononanoic acid, isodecanoic acid, 2,2-dimethyloctanoic acid, 2-butyloctanoic acid and 3,5,5-trimethylhexanoic acid. Partial esters of an aliphatic polyhydric alcohol and a linear or branched fatty acid can also be used. Preferable examples of the ester of an aliphatic polyhydric alcohol and a linear or branched fatty acid include esters of pentaerythritol, dipentaerythritol or tripentaerythritol and a fatty acid having 5 to 12 carbon atoms and preferably 5 to 9 carbon atoms such as valeric acid, hexanoic acid, heptanoic acid, 2-methylhexanoic acid, 2-ethylhexanoic acid, isooctanoic acid, isononanoic acid, isodecanoic acid, 2,2-dimethyloctanoic acid, 2-butyloctanoic acid and 3,5,5-trimethylhexanoic acid.

Partial esters of an aliphatic polyhydric alcohol and a linear or branched fatty acid having 3 to 9 carbon atoms and complex esters of an aliphatic polyhydric alcohol and an aliphatic dibasic acid or an aromatic dibasic acid can also be used. In the complex ester, it is preferable that a fatty acid having 5 to 7 carbon atoms and more preferably 5 or 6 carbon atoms is used. As the above fatty acid, valeric acid, hexanoic acid, isovaleric acid, 2-methylbutyric acid, 2-ethylbutyric acid or a mixture of these acids can be used. Fatty acids obtained by mixing a fatty acid having 5 carbon atoms and a fatty acid having 6 carbon atoms in amounts such that the ratio of the amounts by weight is in the range of 10:90 to 90:10 are preferably used. Examples of the aliphatic dibasic acid used for esterification of the polyhydric alcohol in combination with the fatty acid include succinic acid, adipic acid, pimelic acid, suberic acid, azelaic acid, sebacic acid, undecanedicarboxylic acid, dodecanedicarboxylic acid, tridecanedicarboxylic acid and docosanedicarboxylic acid. Examples of the aromatic dibasic acid used for the esterification include phthalic acid and isophthalic acid. In the esterification reaction for preparing the complex ester, the polyhydric alcohol and the basic acid in prescribed amounts are allowed to react to form a partial ester, which is then allowed to react with the fatty acid. The reactions of the dibasic acid and the fatty acid may be conducted in a reversed order. The dibasic acid and the fatty acid may also be used for the reaction after being mixed together.

Also, an ester of a polyhydric alcohol obtained by reacting an acid fluoride represented by the following general formula (17):

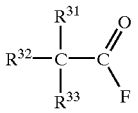

(17)

with a polyhydric alcohol (Japanese Patent Application Laid-Open No. Heisei 9(1997)-157219) can be advantageously used due to small water absorption at saturation. In the general formula (17), $R^{31}$ to $R^{33}$ each represent an alkyl group having 1 to 13 carbon atoms, groups having 4 or more carbon atoms are all branched and the number of carbon atom in the entire groups represented by $R^{31}$ to $R^{33}$ is in the range of 3 to 23;

It is necessary that (A) the polyoxyalkylene glycol, (B) the carbonate-based carbonyl derivative and (C) the polyol ester each have a kinematic viscosity of 3 to 50 $mm^2/s$ and preferably 5 to 40 $mm^2/s$ at 100° C. When the kinematic viscosity is smaller than 3 $mm^2/s$ at 100° C., occasionally, the required lubricity is not surely obtained. When the kinematic viscosity exceeds 50 $mm^2/s$, the practical properties for operation of a refrigerator is adversely affected due to the power loss.

It is necessary that the amount of (B) the carbonate-based carbonyl derivative and/or (C) the polyol ester relative to the total base oil composition is 0.1 to 40% by weight and is preferably 5 to 40% by weight. When the amount is less than 0.1% by weight, the effect of improving the solubility into the carbon dioxide refrigerant decreases. When the amount exceeds 40% by weight, the viscosity index as the lubricating oil composition becomes insufficient.

It is preferable that the base oil composition has a kinematic viscosity of 7 to 30 $mm^2/s$ at 100° C. and a viscosity index of 130 or greater. When the kinematic viscosity at 100° C. is smaller than 7 $mm^2/sec$, the composition does not achieve the required lubricity when carbon dioxide is in the condition of a high temperature and a high pressure. When the kinematic viscosity exceeds 30 $mm^2/s$, the power loss is great and the composition is not suitable. When the viscosity index is smaller than 130, the lubricity reduce and the sealing property becomes insufficient due to a substantial decrease in the kinematic viscosity at high temperatures. Therefore, such viscosity indices are not preferable.

The refrigerating oil composition for a carbon dioxide refrigerant of the present invention is characterized in that the composition comprising (A) the polyoxyalkylene glycol and (B) the carbonate-based carbonyl derivative and/or (C) the polyol ester is used as the base oil. Where necessary, the composition may further comprise an extreme pressure agent, an acid catcher, an antioxidant and an anticorrosion agent.

The extreme pressure agent is not particularly specified and a suitable agent can be selected from conventional extreme pressure agents. In particular, metal salts of carboxylic acids and phosphorus-based extreme pressure agents are suitable.

Various carboxylic acids can be used as the carboxylic acid constituting the metal salt of a carboxylic acid. Examples of the carboxylic acid include aliphatic saturated carboxylic acids, aliphatic unsaturated carboxylic acids, aliphatic dicarboxylic acids and aromatic carboxylic acids. Examples of the aliphatic saturated carboxylic acid include linear saturated acids such as caproic acid, caprylic acid, capric acid, lauric acid, myristic acid, palmitic acid, stearic acid, arachic acid, cerotic acid and laccelic acid; and branched fatty acids such as isopentanoic acid, 2-methylpentanoic acid, 2-methylbutanoic acid, 2,2-dimethylbutanoic acid, 2-methylhexanoic acid, 5-methylhexanoic acid, 2,2-dimethyl-heptanoic acid, 2-ethyl-2-methylbutanoic acid, 2-ethylhexanoic acid, dimethylhexanoic acid, 2-n-propylpentanoic acid, 3,5,5-trimethylhexanoic acid, dimethyloctanoic acid, isotridecanoic acid, isomyristic acid, isostearic acid, isoarachic acid and isohexanoic acid. Examples of the unsaturated carboxylic acid include palmitoleic acid, oleic acid, elaidic acid, linolic acid, and linoleic acid and ricinolic acid. Examples of the aliphatic dicarboxylic acid include adipic acid, azelaic acid and sebacic acid. Examples of the aromatic carboxylic acid include benzoic acid, phthalic acid, trimellitic acid and pyromellitic acid. Alicyclic fatty acids such as naphthenic acid can also be used. The carboxylic acids may be used in combination of two or more.

The metal constituting the metal salt of a carboxylic acid is not particularly specified and various metals can be used. Examples of the metal include alkali metals such as lithium, potassium and sodium; alkaline earth metals such as magnesium, calcium and strontium; and other metals such as zinc, nickel and aluminum. Alkali metals and alkaline earth metals are preferable and alkali metals are more preferable. A single metal or two or more metals may be bonded with one carboxylic acid.

Examples of the phosphorus-based extreme pressure agent include esters of phosphoric acid, acidic esters of phosphoric acid, esters of phosphorous acid, acidic esters of phosphorous acid and amine salts of these esters. Examples of the esters of phosphoric acid include triaryl phosphates, trialkyl phosphates, trialkylaryl phosphates, triarylalkyl phosphates and trialkenyl phosphates. Specific examples of the ester of phosphoric acid include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutyl phenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate and trioleyl phosphate.

Examples of the acidic ester of phosphoric acid include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate and isostearyl acid phosphate.

Examples of the ester of phosphorous acid include triethyl phosphite, tributyl phosphite, tri phenyl phosphite, tricresyl phosphite, tri(nonylphenyl) phosphite, tri(2-ethylhexyl) phosphite, tridecyl phosphite, trilauryl phosphite, triisooctyl phosphite, diphenyl isodecyl phosphite, tristearyl phosphite, trioleyl phosphite and 2-ethylhexyl diphenyl phosphite. Examples of the acidic ester of phosphorous acid include dibutyl hydrogenphosphite, dilauryl hydrogenphosphite, dioleyl hydrogen-phosphite, distearyl hydrogenphosphite and diphenyl hydrogenphosphite.

Examples of the amines forming amine salts with the above esters include monosubstituted amines, disubstituted amines and trisubstituted amines represented by general formula (18):

$$R^{34}{}_sNH_{3-s} \tag{18}$$

wherein $R^{34}$ represents an alkyl group or an alkenyl group having 3 to 30 carbon atoms, an aryl group or an aralkyl group having 6 to 30 carbon atoms or a hydroxyalkyl group having 2 to 30 carbon atoms, s represents a number of 1, 2 or 3 and, when a plurality of $R^{34}$ are present, the plurality of $R^{34}$ may represent the same group or different groups. The alkyl group and the alkenyl group having 3 to 30 carbon atoms which are represented by $R^{34}$ in general formula (18) may be any of linear groups, branched groups and cyclic groups.

Examples of the monosubstituted amine include butylamine, pentylamine, hexylamine, cyclohexylamine, octylamine, laurylamine, stearylamine, oleylamine and benzylamine. Examples of the disubstituted amine include dibutylamine, dipentylamine, dihexylamine, dicyclohexylamine, di octylamine, dilaurylamine, distearylamine, dioleylamine, dibenzylamine, stearylmonoethanolamine, decyl-monoethanolamine, hexylmonopropanolamine, benzylmonoethanolamine, phenylmonoethanolamine and tolylmonopropanolamine. Examples of the trisubstituted amine include tributylamine, tripentylamine, trihexylamine, tricyclohexylamine, tri octylamine, trilaurylamine, tristearylamine, trioleylamine, tribenzylamine, dioleylmonoethanolamine, dilauryl-monopropanolamine, dioctylmonoethanolamine, dihexylmonopropanolamine, dibutylmonopropanolamine, oleyldiethanolamine, stearyl-dipropanolamine, lauryldiethanolamine, octyldipropanolamine, butyldiethanolamine, benzyldiethanolamine, phenyldiethanolamine, tolyldipropanolamine, xylyldiethanolamine, triethanolamine and tripropanolamine.

Among the phosphorus-based extreme pressure agents, tricresyl phosphate, tri(nonylphenyl) phosphite, dioleyl hydrogenphosphite and 2-ethylhexyl diphenyl phosphite are preferable from the standpoint of the extreme pressure property and the friction property.

In the present invention, the extreme pressure agent may be used singly or in combination of two or more. It is preferable that a combination of the metal salt of a carboxylic acid and the phosphorus-based extreme pressure agent is used since the lubricity of a refrigerating oil can be further improved under the atmosphere of carbon dioxide in the supercritical condition. It is preferable that the amount of the extreme pressure agent is in the range of 0.005 to 5.0% by weight based on the amount of the base oil composition. When the amount is less than 0.005% by weight, there is the possibility that the extreme pressure property and the friction property are insufficient. When the amount exceeds 5.0% by weight, there is the possibility that generation of sludge is promoted.

Examples of the acid catcher include epoxy compounds such as phenyl glycidyl ether, alkyl glycidyl ethers, alkylene glycol glycidyl ethers, cyclohexene oxide, a-olefin oxides and epoxidized soy bean oil. Among the above acid catchers, phenyl glycidyl ether, alkyl glycidyl ethers, alkylene glycol glycidyl ethers, cyclohexene oxide and α-olefin oxides are preferable from the standpoint of the miscibility.

In the present invention, the acid catcher may be used singly or in combination of two or more. It is preferable that the amount is in the range of 0.005 to 5% by weight based on the amount of the base oil composition. When the amount is less than 0.005% by weight, there is the possibility that the effect of adding the acid catcher is not exhibited. When the amount exceeds 5% by weight, there is the possibility that sludge is formed. When the salt of a carboxylic acid and the phosphorus-based extreme pressure agent are used in combination as the extreme pressure agent and the above acid catcher is further used in combination, excellent effects are exhibited in that stability of the refrigerating oil exposed to carbon dioxide in the supercritical condition is improved and the lubricity is maintained. When the extreme pressure agent and the acid catcher are used in combination, it is preferable that the total amount of the extreme pressure agent and the acid catcher is in the range of 0.005 to 5% by weight based on the amount of the base oil composition.

As the antioxidant, phenol-based antioxidants such as 2,6-di-tert-butyl-4-methylphenol, 2,6-di-tert-butyl-4-ethylphenol and 2,2'-methylene-bis(4-methyl-6-tert-butylphenol) and amine-based antioxidants such as phenyl-α-naphthylamine, phenyl-β-naphthylamine and N,N'-diphenyl-p-phenylenediamine are used. Among these antioxidants, phenol-based antioxidants are preferable. When the above antioxidant is used in combination with the extreme pressure agent and the acid catcher, an excellent effect is exhibited in that stability of the refrigerating oil exposed to carbon dioxide in the supercritical condition is further improved.

As an anticorrosion agent (that functions as an oiliness agent), (x) ethers and esters of aliphatic polyhydric alcohols having a functionality of 3 to 6 and (y) ethers and esters of condensates of two or three molecules of aliphatic polyhydric alcohols having a functionality of 3 to 6 are preferably used.

The compounds of component (x) and component (y) will be explained in the following description. Preferable examples of the ether and the ester of aliphatic polyhydric alcohols having a functionality of 3 to 6 of component (x) include compounds represented by the following general formulae (XV-a) to (XV-f):

(XV-a)

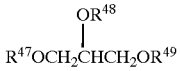

(XV-b)

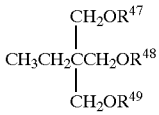

(XV-c)

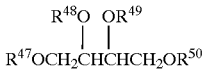

(XV-d)

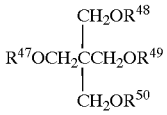

(XV-e)

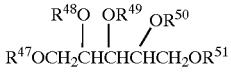

(XV-f)

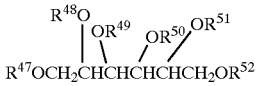

In the formulae (XV-a) to (XV-f), $R^{47}$ to $R^{52}$ each represent hydrogen atom or an alkyl group, an aryl group, an aralkyl group or an acyl group which has 1 to 18 carbon atoms and may be linear or branched. The atoms or the groups represented by $R^{47}$ to $R^{52}$ may be the same with or different from each other. $R^{47}$ to $R^{52}$ each may represent a glycol ether residue group represented by $—(R^aO)_x—R^b$, wherein $R^a$ represents an alkylene group having 2 to 6 carbon atoms, Rb represents an alkyl group, an aryl group, an aralkyl group or an acyl group which has 1 to 20 carbon atoms and x represents an integer of 1 to 10.

Examples of the aliphatic polyhydric alcohol having a functionality of 3 to 6 include glycerol, trimethylolpropane, erythritol, pentaerythritol, arabitol, sorbitol and mannitol. Examples of the group represented by $R^{47}$ to $R^{52}$ in the above formulae (XV-a) to (XV-f) include methyl group, ethyl group, n-propyl group, isopropyl group, various types of butyl group, various types of pentyl group, various types of hexyl group, various types of heptyl group, various types of octyl group, various types of nonyl group, various types of decyl group, various types of undecyl group, various types of dodecyl group, various types of tridecyl group, various types of tetradecyl group, various types of pentadecyl group, various types of hexadecyl group, various types of heptadecyl group, various types of octadecyl group, phenyl group, benzyl group, methoxyl group and ethoxyl group. $R^{47}$ to $R^{52}$ may also represent hydrogen atom and, in this case, the above compound is a partial ether.

As for the ethers and the esters of condensates of two or three molecules of aliphatic polyhydric alcohols having a functionality of 3 to 6 of component (y), for example, ethers and esters of alcohols corresponding to general formula (XV-a) are represented by general formulae (XV-g) and (XV-h) and ethers and esters of alcohols corresponding to general formula (XV-d) are represented by general formulae (XV-i) and (XV-j):

(XV-g)

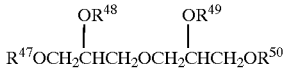

(XV-h)

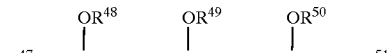

(XV-i)

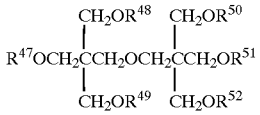

(XV-j)

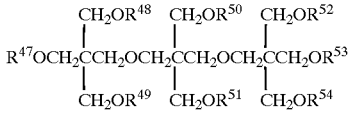

In the formulae (XV-i) and (XV-j), $R^{47}$ to $R^{54}$ are the same as definition described regarding $R^{47}$ to $R^{52}$ in the formulae (XV-a) to (XV-f), The atoms or the groups represented by $R^{47}$ to $R^{54}$ may be the same with or different from each other. Examples of the condensate of two or three molecules of an aliphatic polyhydric alcohol having a functionality of 3 to 6 include diglycerol, ditrimethylolpropane, dipentaerythritol, disorbitol, triglycerol, tritrimethylolpropane, tripentaerythritol and trisorbitol.

Examples of components (x) and (y) represented by the general formulae (XV-a) to (XV-j) include trihexyl ether of glycerol, dimethyloctyl triether of glycerol, di(methyloxyisopropylene)dodecyl triether of glycerol, diphenyloctyl triether of glycerol, di(phenyloxy-isopropylene)dodecyl triether of glycerol, trihexyl ether of trimethylol-propane, dimethyloctyl triether of trimethylolpropane, di(methyloxy-isopropylene)dodecyl triether of trimethylolpropane, tetrahexyl ether of pentaerythritol, trimethyloctyl tetraether of pentaerythritol, tri(methyloxyisopropylene)dodecyl tetraether of pentaerythritol, hexapropyl ether of sorbitol, tetramethyloctyl pentaether of sorbitol, hexa(methyloxyisopropylene) ether of sorbitol, tetrabutyl ether of diglycerol, dimethyldioctyl tetraether of diglycerol, tri(methyloxy-isopropylene) dodecyl tetraether of diglycerol, pentaethyl ether of triglycerol, trimethyldioctyl pentaether of triglycerol, tetra (methyloxy-isopropylene)decyl pentaether of triglycerol, tetrabutyl ether of ditrimethylolpropane, dimethyldioctyl tetraether of ditrimethylolpropane, tri (methyloxyisopropylene)dodecyl tetraether of ditrimethylolpropane, pentaethyl ether of tritrimethylolpropane, trimethyldioctyl pentaether of tritrimethylolpropane, tetra(methyloxyisopropylene)decyl pentaether of tritrimethylolpropane, hexapropyl ether of dipentaerythritol, pentamethyloctyl hexaether of dipentaerythritol, hexa(methyloxy-isopropylene) ether of dipentaerythritol, octapropyl ether of tripentaerythritol, pentamethyloctyl hexaether of tripentaerythritol, hexa (methyloxyisopropylene) ether of tripentaerythritol, octamethyl-dioctyl decaether of disorbitol and deca (methyloxyisopropylene) ether of disorbitol; and esters corresponding to the above ethers. Among the above compounds, diphenyloctyl triether of glycerol, di(methyloxy-isopropylene)dodecyl triether of trimethylolpropane, tetrahexyl ether of pentaerythritol, hexapropyl ether of sorbitol, dimethyldioctyl tetraether of diglycerol, tetra(methyloxyisopropylene)decyl pentaether of triglycerol, hexapropyl ether of pentaerythritol and pentamethyloctyl hexaether of tripentaerythritol are preferable.

The kinematic viscosity of components (x) and (y) at 40° C. is in the range of 5 to 200 $mm^2/s$ and preferably in the range of 10 to 100 $mm^2/s$. When the kinematic viscosity is smaller than 5 $mm^2/s$, the effect of improving the lubricity and preventing clogging of capillaries is small. When the kinematic viscosity exceeds 200 $mm^2/s$, miscibility with the refrigerant (the temperature of phase separation) decreases. Therefore, such kinematic viscosities are not preferable. In the lubricating oil composition for refrigerators of the present invention, the foregoing components (x) and (y) may be used singly or in combination of two or more. It is preferable that the amount of components (x) and (y) are in the range of 0.1 to 30% by weight based on the amount of the entire composition. When the amount is less than 0.1% by weight, the object of the present invention is not sufficiently achieved. When the amount exceeds 30% by weight, the effect is not exhibited to the degree expected from the amount and solubility into the base oil occasionally decreases. It is more preferable that the amount is in the range of 0.1 to 15% by weight and most preferably in the range of 0.5 to 10% by weight.

The lubricating oil composition constituting the refrigerating oil composition of the present invention may further comprise conventional various additives such as copper deactivating agents such as benzotriazole and derivatives thereof and defoaming agents such as silicone oils and fluorinated silicone oils in suitable amounts as long as the object of the present invention is not adversely affected. The additives are comprised in the lubricating oil composition in an amount of 0.5 to 10% by weight.

As for the process for producing the refrigerating oil composition of the present invention, it is sufficient that (B) the carbonate-based carbonyl derivative and/or (C) the polyol ester and, where necessary, the extreme pressure agent, the acid catcher, the antioxidant and an anticorrosion agent are mixed with the polyoxyalkylene glycol and a process can be selected from various processes for producing the composition.

When a metal salt of a carboxylic acid is used as the extreme pressure agent, however, a carboxylic acid and an alkali hydroxide is added to a solvent and the reaction is allowed to proceed at the room temperature or under heating to obtain a solution or a dispersion of the metal salt of the carboxylic acid. The object composition can be efficiently produced by using the obtained solution or the dispersion.

As the solvent used above, various solvents can be used. Examples of the solvent include monohydric alcohols such as n-butyl alcohol, isobutyl alcohol, sec-butyl alcohol, t-butyl alcohol, n-amyl alcohol, isoamyl alcohol, sec-amyl alcohol, n-hexyl alcohol, methylamyl alcohol, ethylbutyl alcohol, heptyl alcohol, n-octyl alcohol, sec-octyl alcohol, 2-ethylhexyl alcohol, isooctyl alcohol, n-nonyl alcohol, 2,6-dimethyl-4-heptanol, n-decyl alcohol and cyclohexanol; glycols and polyhydric alcohols such as ethylene glycol, diethylene glycol, triethylene glycol, tetraethylene glycol, propylene glycol, dipropylene glycol, 1,4-butylene glycol, 2,3-butylene glycol, hexylene glycol, octylene glycol and glycerol; cellosolves such as ethylene glycol monomethyl ether, ethylene glycol ethyl ether, ethylene glycol diethyl ether, ethylene glycol butyl ether, ethylene glycol dibutyl ether, ethylene glycol phenyl ether, ethylene glycol benzyl ether, ethylene glycol ethyl hexyl ether, diethylene glycol ethyl ether, diethylene glycol diethyl ether, diethylene glycol butyl ether, diethylene glycol dibutyl ether, propylene glycol methyl ether, propylene glycol ethyl ether, propylene glycol butyl ether, dipropylene glycol methyl ether, dipropylene glycol ethyl ether, tripropylene glycol methyl ether, tetraethylene glycol dimethyl ether and tetraethylene glycol dibutyl ether; crown ethers such as benzo-15-crown-5, benzo-12-crown-4, benzo-18-crown-6 and dibenzo-18-crown-6; ketones such as ethyl butyl ketone, dipropyl ketone, methyl amyl ketone, methyl hexyl ketone and diisobutyl ketone; and fatty acids such as fatty acids having 3 to 30 carbon atoms described above. The concentration of the salt of a carboxylic acid dissolved or dispersed into the foregoing solvent is not particularly specified and can be suitably selected in accordance with the situation.

In the present invention, any carbon dioxide refrigerant can be used as long as the refrigerant comprises carbon dioxide as the main component. The refrigerant may further comprise hydrocarbon refrigerants such as propane and isobutane, ammonia refrigerants and refrigerants containing fluorine such as hydrofluorocarbons and fluorocarbons, a typical example of which is 1,1,1,2-tetrafluorocarbon (R-134a). Even when the refrigerant comprises the above components other than carbon dioxide, the effect of the present invention can be exhibited as long as the refrigerant comprises carbon dioxide as the main component.

In the process for lubricating refrigerators using the refrigerating oil composition of the present invention, it is preferable that the ratio of the amounts by weight of the carbon dioxide refrigerant to the refrigerating oil composition is in the range of 99/1 to 10/90. When the ratio is smaller than the above range, the refrigerating ability decreases. When the ratio exceeds the above range, the lubricity deteriorates. Therefore, amounts outside the above range are not preferable. From the above standpoint, it is more preferable that the ratio of the amounts by weight of the carbon dioxide refrigerant to the refrigerating oil composition is in the range of 95/5 to 30/70.

Figure 2:
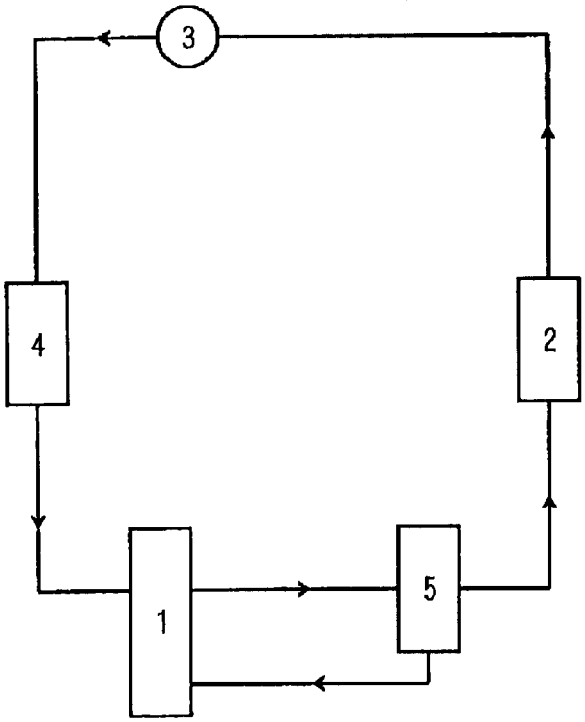
FIG. 2 shows a flow diagram that exhibits an example of the compression type refrigerating cycle of the "compressor—condenser—expansion valve—evaporator" system having an oil separator.
Figure 3:
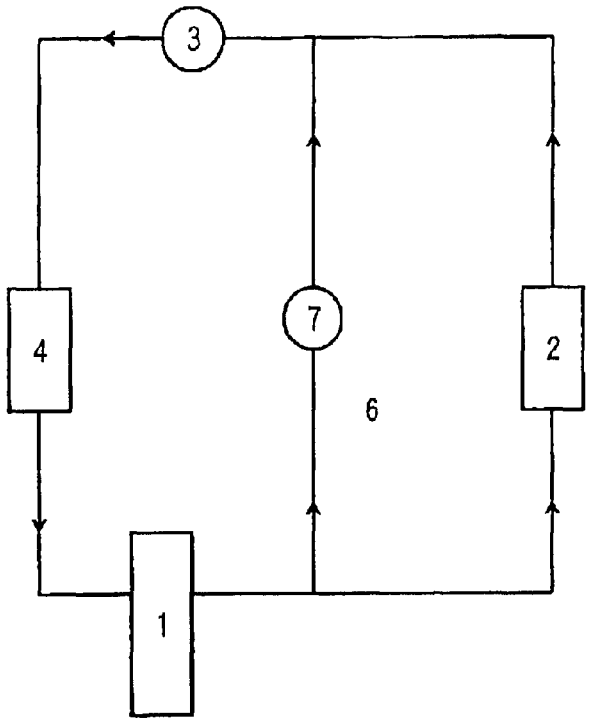
FIG. 3 shows a flow diagram that exhibits an example of the compression type refrigerating cycle of the "compressor-condenser—expansion valve—evaporator" system having a hot gas line.
Figure 4:
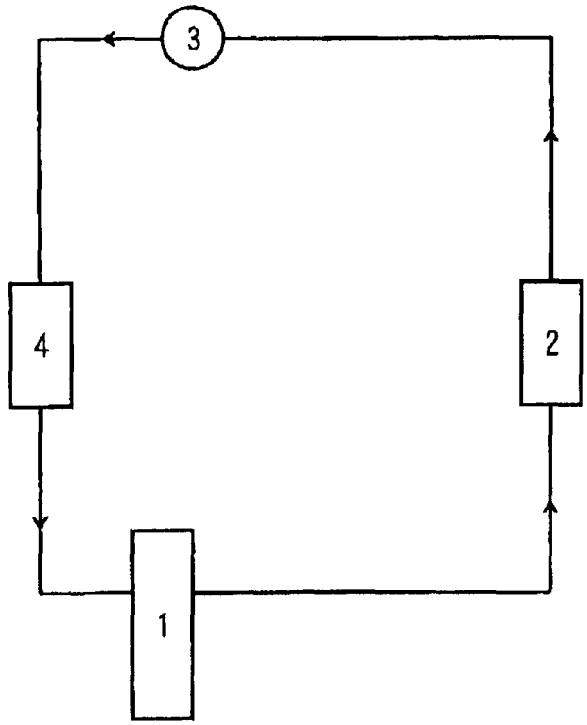
FIG. 4 shows a flow diagram which exhibits an example of the compression type refrigerating cycle of the "compressor—condenser—expansion valve—evaporator" system.

The refrigerating oil composition of the present invention can be applied to various types of refrigerators. In particular, the refrigerating oil composition of the present invention is advantageously applied to compression-type refrigerating cycles in compression-type refrigerators. For example, the refrigerating oil composition can be advantageously applied to refrigerators disclosed in Japanese Patent Application Laid-Open Nos. Heisei 4(1992)-183788, Heisie 8(1996)-259975, Heisei 8(1996)-240362, Heisie 8(1996)-253779, Heisei 8(1996)-240352, Heisei 5(1993)-17792, Heisei 8(1996)-226717 and Heisei 8(1996)-231972. For example, the advantageous effects can be exhibited when the refrigerating oil composition of the present invention is applied to compression-type refrigerating cycles having an oil separator and/or a hot gas line such as the refrigerating cycles shown in FIGS. 1 to 3. In general, a compression-type refrigerating cycle is constituted with a compressor, a condenser, an expansion valve and an evaporator. As the lubricant for a refrigerator, a lubricant exhibiting excellent miscibility with the refrigerant used for the refrigerator is used. However, when a refrigerant comprising carbon dioxide as the main component is used for the above refrigerating cycle and the refrigerator is lubricated with a conventional refrigerating oil, antiwear is poor and a stable operation for a long period cannot be achieved due to insufficient stability. In particular, the drawbacks are marked when a capillary tube is used as the expansion valve in the refrigerating cycle in electric refrigerators and small air conditioners. The refrigerating oil composition of the present invention can be effectively used even when a compression-type refrigerating cycle having an oil separator and/or a hot gas line is operated using a refrigerant comprising carbon dioxide as the main component.

EXAMPLE

The present invention will be described below in further details with reference to the following examples.

The test methods used in the examples were as follows.

[Critical Soluble Temperature]

Into a pressure-resistant glass container having an inner volume of 10 ml, a sample oil and a refrigerant of carbon dioxide gas were placed in amounts such that the ratio of the amounts by weight of the sample oil to the refrigerant was 1:9 and the total amount was 3.0 g. After the container was sealed and the content was made into a homogeneous solution, the temperature was slowly elevated. The temperature at which the sample oil and the refrigerant began to separate from each other was measured and defined as the critical soluble temperature.

[Stability]

Into an autoclave having an inner volume of 120 ml, 40 g of a sample oil, 40 g of a refrigerant of carbon dioxide gas and a metal catalyst containing copper, aluminum and iron were placed and water was added to the system in an amount such that the content of water was adjusted to 2,000 ppm. After the autoclave was closed and kept at 175° C. for 10 days, the sample oil was analyzed. The pressure inside the system during the test was 16 MPa.

[Antiwear]

Using a pin made of steel (SUJ-2) and a block made of aluminum (A4032), the decrease in the amount (mg) of the block by wear was measured in the atmosphere of a refrigerant of carbon dioxide gas in accordance with the Falex friction test in the closed system. The conditions of the test were as follows:

| | |
|---|---|
| the amount of the sample oil | 300 ml; |
| the temperature of the oil | 50° C.; |
| the pressure of carbon dioxide gas | 2 MPa; |
| the speed of rotation | 2,000 rpm; |
| the load | 350 lbs; and |
| the time of the test | 60 minutes. |

Examples 1 to 5 and Comparative Examples 1 and 2

The measurement of the critical soluble temperature, the test of stability and the test of friction were conducted using the refrigerating oil compositions shown in Table 1. The results are shown in Table 2. To each refrigerating oil composition in Examples and Comparative Examples, 1.5% by weight of an acid catcher (an α-olefin oxide) and 0.5% by weight of an antioxidant (2,6-di-tert-butyl-4-methylphenol) based on the amount of the base oil composition were added although these agents are not shown in Table 1.

In Table 1, the components of the base oil and the extreme pressure agents are abbreviated as follows.

(1) Components of the base oil {The number in ( ) shows the composition of a copolymer and the number in [ ] shows the kinematic viscosity at 100° C.}

Component (A) (Polyoxyalkylene Glycol)

PAG-A: Polyoxypropylene glycol dimethyl ether [10.9 $mm^2/s$]

PAG-B: Polyoxyethylene(20)oxypropylene(80) glycol dimethyl ether [20.5 $mm^2/s$]

PAG-C: polyoxypropylene glycol monomethyl ether [9.7 $mm^2/s$]

PAG-D: Polyoxyethylene(10)oxypropylene(90) glycol mono-(n-butyl) ether [11.2 $mm^2/s$]

Component (B) (Carbonate-Based Carbonyl Derivative)

PC-1: A carbonate-based carbonyl derivative obtained in accordance with the process of Example 3 in Japanese Patent Application Laid-Open No. Heisei 4(1992)-8724 [13.0 $mm^2/s$]

PC-2: A carbonate-based carbonyl derivative obtained in accordance with the process of Example 2 in Japanese Patent Application Laid-Open No. Heisei 4(1992)-8725 [10.2 $mm^2/s$]

Component (C) (Polyol Ester)

POE-1: Pentaerythritol/2-ethylhexanoic acid(0.2)+3,5,5-trimethylhexanoic acid [14.7 $mm^2/s$]

POE-2: Pentaerythritol+3,5,5-trimethylhexanoic acid [9.1 $mm^2/s$]

(2) Extreme Pressure Agent

| | |
|---|---|
| TCP: | tricresyl phosphate |
| TNP: | trisnonyiphenyl phosphite |
| DOHP: | dioleyl hydrogenphosphite |

TABLE 1

| | Base oil composition | | | | | | Extreme pressure agent | | | |
|---|---|---|---|---|---|---|---|---|---|---|
| | component (A) | | component (B), (C) | | kinematic viscosity, 100° C. | visco-sity | metal salt of carboxylic acid | | phosphorus-based extreme pressure agent | |
| | type | amount | type | amount | ($mm^2/s$) | index | type | amount | type | amount |
| Example 1 | PAG-A | 70 | POE-1 | 30 | 11.9 | 173 | K oleate | 1.0 | TCP | 1.0 |
| Example 2 | PAG-B | 65 | POE-2 | 35 | 15.1 | 155 | K oleate | 0.5 | TNP | 1.0 |
| Example 3 | PAG-C | 80 | PC-1 | 20 | 10.3 | 166 | K sebacate | 0.5 | TCP | 1.0 |
| Example 4 | PAG-D | 90 | PC-2 | 10 | 11.1 | 201 | K oleate | 1.0 | DOHP | 1.0 |
| Example 5 | PAG-A | 80 | PC-1 | 20 | 11.3 | 184 | K oleate | 0.5 | TCP | 1.0 |
| Comparative Example 1 | PAG-A | 100 | — | — | 10.9 | 217 | K oleate | 0.5 | TCP | 1.0 |
| Comparative Example 2 | PAG-C | 100 | — | — | 9.7 | 187 | — | — | TCP | 1.0 |

Notes:

Composition: the composition of a base oil composition (% by weight)

Amount: the amount based on the amount of the base oil composition (% by weight)

TABLE 2

| | Critical soluble temperature (° C.) | Stability | | | | Antiwear amount of wear (mg) |
|---|---|---|---|---|---|---|
| | | appearance of oil | precipitates | metal catalyst | total acid value after test (mgKOH/g) | |
| Example 1 | −14 | good | none | no change | 0.08 | 3.3 |
| Example 2 | −36 | good | none | no change | 0.07 | 3.2 |
| Example 3 | −28 | good | none | no change | 0.06 | 2.8 |
| Example 4 | −36 | good | none | no change | 0.06 | 2.2 |
| Example 5 | −22 | good | none | no change | 0.06 | 3.2 |
| Comparative Example 1 | separated | good | none | no change | 0.03 | 3.0 |
| Comparative Example 2 | separated | good | none | no change | 0.02 | 14.2 |

INDUSTRIAL APPLICABILITY

Although application of a compound having oxygen such as a polyoxylalkylene glycol and a polyol ester to the base oil of a refrigerating oil for a carbon dioxide refrigerant has been attempted separately as a single compound, application of a combination of these compounds has heretofore not been made.

In the present invention, since a composition comprising a polyoxyalkylene glycol having a specific kinematic viscosity and a carbonate-based carbonyl compound and/or a polyol ester having a specific kinematic viscosity in specific relative amounts is used as the base oil, miscibility of the oil with carbon dioxide is remarkably improved without adverse effects on the stability proper to the polyoxyalkylene glycol and the use for a long time with stability is made possible.

What is claimed is:

1. A refrigerant composition comprising a carbon dioxide refrigerant and a base oil composition which comprises (A) a polyoxyalkylene glycol having a kinematic viscosity of 3 to 50 $mm^2/s$ at 100° C. and at least one component selected from (B) a carbonate-based carbonyl derivative having a kinematic viscosity of 3 to 50 $mm^2/s$ at 100° C. and (C) a polyol ester having a kinematic viscosity of 3 to 50 $mm^2/s$ at 100° C., wherein an amount of (B) and/or (C) is 0.1 to 40% by weight of the total base oil composition.

2. The refrigerant composition according to claim 1, wherein said base oil composition has a kinematic viscosity of 7 to 30 $mm^2/s$ at 100° C. and a viscosity index of 130 or greater.

3. The refrigerant composition according to claim 1, wherein the base oil composition further comprises at least one acid catcher in an entire amount of 0.005 to 5.0% by weight.

4. The refrigerant composition according to claim 2, wherein the base oil composition further comprises at least one acid catcher in an entire amount of 0.005 to 5.0% by weight.

5. The refrigerant composition according to claim 1, wherein the base oil composition further comprises at least one extreme pressure agent in an entire amount of 0.005 to 5.0% by weight.

6. The refrigerant composition according to claim 2, wherein the base oil composition further comprises at least one extreme pressure agent in an entire amount of 0.005 to 5.0% by weight.

7. The refrigerant composition according to claim 5, wherein said extreme pressure agent is at least one agent selected from a group consisting of metal salts of carboxylic acids and phosphorus-based extreme pressure agents.

8. The refrigerant composition according to claim 6, wherein said extreme pressure agent is at least one agent selected from a group consisting of metal salts of carboxylic acids and phosphorus-based extreme pressure agents.

9. A refrigerant composition comprising a carbon dioxide refrigerant and a base oil composition which consists essentially of (A) a polyoxyalkylene glycol having a kinematic viscosity of 3 to 50 $mm^2/s$ at 100° C. and at least one component selected from (B) a carbonate-based carbonyl derivative having a kinematic viscosity of 3 to 50 $mm^2/s$ at 100° C. and (C) a polyol ester having a kinematic viscosity of 3 to 50 $mm^2/s$ at 100° C., wherein an amount of (B) and/or (C) is 0.1 to 40% by weight of the total base oil composition.

10. The refrigerant composition according to claim 9, wherein said base oil composition has a kinematic viscosity of 7 to 30 $mm^2/s$ at 100° C. and a viscosity index of 130 or greater.

11. The refrigerant composition according to claim 1, wherein (B) is present.

12. The refrigerant composition according to claim 1, wherein (C) is present.

13. The refrigerant composition according to claim 2, wherein (B) is present.

14. The refrigerant composition according to claim 2, wherein (C) is present.

15. The refrigerant composition according to claim 9, wherein (B) is present.

16. The refrigerant composition according to claim 9, wherein (C) is present.

17. The refrigerant composition according to claim 10, wherein (B) is present.

18. The refrigerant composition according to claim 10, wherein (C) is present.

* * * * *